United States Patent [19]

Eklund

[11] 4,349,413

[45] Sep. 14, 1982

[54] CELLULOSIC FIBER INSULATION AND PROCESS OF PREPARATION

[75] Inventor: Henrik J. Eklund, Middletown, Ohio

[73] Assignee: The Black Clawson Company, Middletown, Ohio

[21] Appl. No.: 212,917

[22] Filed: Dec. 4, 1980

Related U.S. Application Data

[63] Continuation of Ser. No. 60,242, Jul. 25, 1979, abandoned.

[51] Int. Cl.[3] ..... D21B 1/16

[52] U.S. Cl. ..... 162/23; 162/26; 162/80; 162/159; 162/183

[58] Field of Search ..... 162/13, 25–28, 162/159, 183, 80, 23; 428/921; 106/15.05

[56] References Cited

U.S. PATENT DOCUMENTS

| | | | |
|---|---|---|---|
| 2,325,055 | 7/1943 | Heritage | 162/13 |
| 2,454,532 | 11/1948 | Walter | 162/26 |
| 3,388,037 | 6/1968 | Asplund et al. | 162/26 |

*Primary Examiner*—Peter Chin

*Attorney, Agent, or Firm*—Biebel, French & Nauman

[57] ABSTRACT

Thermal insulating material of cellulosic fibers is prepared by treating wood chips or other fibrous cellulosic material with saturated steam at elevated temperatures and pressures and then fiberizing the treated material. A fire-retardant chemical is added to the material immediately prior to fiberization. The resulting fiberized cellulosic material when dried exhibits superior flame and fire resistance properties.

9 Claims, No Drawings

CELLULOSIC FIBER INSULATION AND PROCESS OF PREPARATION

This is a continuation of application Ser. No. 060,242 filed July 25, 1979 abandoned.

BACKGROUND OF THE INVENTION

The present invention relates to thermal insulation material and more particularly to insulation made from cellulosic fibers having high flame-retardant properties.

Fiberized wood or other fibrous cellulosic material serves as an excellent insulating material when blown into the walls, floors, or attic of a home or other type of building that must be protected against heat losses. Cellulosic insulating materials are light in weight and inexpensive. The R value per inch of such insulating material is quite high and in many cases may equal or exceed the R value per inch of fiberglass batting.

The use of fiberized wood or other cellulosic material as insulation is known in the art. For example, Heritage, U.S. Pat. No. 2,325,055, teaches forming a thermal insulation material by refining wood chips at elevated temperatures in the presence of steam. Various bonding, fire-proofing, and mold-preventing agents are added to the material prior to its entry into the refiner. Portz, U.S. Pat. No. 2,470,641, adds dry boric acid to disintegrated newsprint to form a fire-resistant insulating material.

However, there has been a reluctance in the past to use cellulosic insulating materials because of problems with insuring adequate fire resistance of the material. To meet stringent fire regulation standards the insulating material must not be ignitable in the presence of heat. Present federal regulations require cellulosic insulating material to have a critical radiant flux of at least 0.12 watts/cm$^2$.

Accordingly, the need still exists in the art for a process of preparing wood or other cellulosic fiber insulating material which meets or exceeds the regulated fire resistance standards.

SUMMARY OF THE INVENTION

The present invention meets that need by providing a cellulosic fiber insulating material and process of preparing it which has excellent fire resistance properties and yet is inexpensive to manufacture and easy to use. In accordance with the process of the present invention, hard and/or soft wood chips or other cellulosic material such as bagasse, straw, and the like are loaded into a pressurized steaming chamber. There the chips are pretreated with steam under pressure and at elevated temperatures for a sufficient period of time to soften the chips and moisturize them by steam impregnation. The steam pressures may be from about 60–150 psig, the temperatures from about 270°–370° F. and the time of pretreatment fairly short, i.e. on the order of 3–6 minutes.

The softened chips are then passed to a refiner or other fiberizing device where they are refined under pressure. Preferably, a single or double disc refiner or one having bar-type grinding segments is used. A fire-retardant chemical such as borax or boric acid is added directly into the refiner immediately prior to the grinding disc or discs where it is uniformly dispersed throughout the wood fibers due to the mixing and fiberizing action of the refiner. A charge of 20–30 percent by weight of borax (based on bone dry cellulose fiber) is preferred. It may be added as a concentrated aqueous solution or on a dry basis.

The fiberized material exits from the refining stage and is immediately brought down to atmospheric pressure. Because of the rapid depressurization, a considerable amount of steam is flashed off of the material leaving a lower moisture content for drying. The material is then conventionally dried and baled. When used as insulation, the bales are shredded at the building site to fluff up the material and blown into the walls, floors, and attic.

Although the pretreatment steps of heating and softening of the cellulose fibers are important to the process, it has been found that the point of injection of fire-retardant chemical is critical to the production of an insulating material having superior fire and flame resistant properties. Thus, it is essential to the practice of the present invention that the fire-retardant chemical, preferably borax, is added directly into the eye of the refiner immediately prior to the grinding disc or discs.

Accordingly, it is an object of the present invention to provide a highly fire and flame resistant cellulosic insulating material and process for its preparation. This and other objects and advantages of the invention will become apparent from the following description and appended claims.

DESCRIPTION OF THE PREFERRED EMBODIMENTS

Several fibrous cellulosic materials can be utilized as starting materials for the process of the present invention including straw and bagasse although it is preferred that hard or soft wood chips be used. The cellulosic materials are first loaded into a pressurized chamber where they are softened under the application of heat and pressure. In a preferred arrangement, wood chips are supplied to the chamber from a chip storage bin via a hopper and screw feeder which forces a dense plug of chips into the pressurized chamber.

The cellulosic materials are then exposed to saturated steam at from about 60 to about 150 psig and at temperatures of about 270° to 370° F. for three to six minutes. Treatment times, pressures, and temperatures will vary somewhat depending upon the nature of the material being treated. Generally, the upper limit of pressure and temperature will correspond to the lesser treatment time and vice versa. In a preferred embodiment, wood chips are steamed at from 60–100 psig and 277°–309° F. for 3–5 minutes.

The softened fibrous cellulosic material is then transferred by suitable means such as a screw conveyor to a refiner or other fiberizing device. Preferably, a refiner having single or double discs or bar-type grinding segments is utilized. At this point in the process, a fire-retardant chemical such as borax, boric acid, or a borate is added directly into the refiner immediately prior to the grinding discs or segments. By adding the fire-retardant chemical at this point, rather than during pretreatment or after fiberization, the chemical is uniformly dispersed throughout the cellulosic fibers due to the mixing and fiberizing action of the refiner yielding a superior flame and fire resistant thermal insulation material. It has been found that the addition of the fire-retardant chemical to the fibers immediately prior to fiberization is critical in obtaining superior fire resistance properties.

The fire-retardant chemical may be added in a dry, powdered state or may be injected as a concentrated aqueous solution. In a preferred embodiment, borax is injected into the refiner at a charge of about 20–30 percent by weight borax to dry fiber weight. If an aqueous solution of borax is used, it has been found that a 20 percent by weight borax solution yields excellent results.

The treated fiberized material is then blown from the pressurized refiner to atmospheric pressure. Because of the rapid depressurization, a considerable amount of moisture present in the fiberized material is flashed off as steam, lowering the moisture content of the material and rendering easier and less expensive to dry. If the fire-retardant chemical has been added in a dry state at the refining stage, there is even less moisture in the material which has to be driven off by drying.

The material may then be dried in a conventional manner such as by blowing heated air through it and packed in bales. When needed for use as insulation, the bales may be easily transported to the building site, shredded, and blown into walls and attics and under floors.

In order to better understand the invention, reference is made to the following nonlimiting examples.

EXAMPLE I

Thermal insulation was prepared according to the process of the present invention by treating wood chips in a pressurized chamber with approximately 100 psig saturated steam at about 277°–309° F. for five minutes. It was then refined with borax being added directly into the refiner immediately before the grinding segments as a 20 percent by weight concentrated aqueous solution. A total of 20–25 percent by weight borax was added based on the original dry weight of the wood chips. After fiberization, the insulation material was dried.

The insulation was then tested for flame spread (per ASTM designation E-84) and flame resistance (per ASTM designation C-739). Both the flame spread and flame resistance ratings were well within federal specification HH-I-515C for Type I insulation. Other tests were performed showing that the insulation has no objectionable odors, does not corrode metals, has an average 4.6 percent moisture absorption, a starch content of less than 1 percent, and a thermal resistance (R) value of 3.38/inch.

EXAMPLE II

Three different samples of insulation were prepared by treating wood chips in a pressurized chamber with 100 psig saturated steam gradually lowered to 60 psig by the end of a five minute treatment period. Temperatures in the chamber ranged from 309° F. to 277° F. The wood chips were then refined in a bar-type grinding segment refiner. Borax was added as a 20 percent by weight concentrated aqueous solution; total borax added amounted to 20–25 percent by weight of the original dry weight of the wood chips. The only difference in the samples prepared was that Sample A was prepared in accordance with the practice of the present invention by injecting the borax into the eye of the refiner immediately before the grinding segments. Borax was injected into Sample B in the blow line as the material exited the refiner. Borax was added to Sample C during the steaming and preheating stage of the process.

All of the samples were tested in compliance with federal specification HH-I-515D. That specification requires a critical radiant flux of at least 0.12 watts/cm$^2$ for cellulosic thermal insulation. The results of the tests are reported in Table I below.

TABLE I

| | Critical Radiant Flux | | | |
|---|---|---|---|---|
| Sample | Run 1 Watts/cm$^2$ | Run 2 Watts/cm$^2$ | Run 3 Watts/cm$^2$ | Average Watts/cm$^2$ |
| A | 0.92 | 0.82 | 0.86 | 0.86 |
| B | 0.55 | 0.54 | 0.55 | 0.55 |
| C | <0.09 | <0.09 | <0.09 | <0.09 |

As can be seen, Sample A, prepared in accordance with the process of the present invention exhibits superior results of a magnitude of 60 percent greater than Sample B and 950 percent greater than Sample C. The critical radiant flux values for Sample A are over seven times greater than federal standards require.

While the process and product herein described constitute preferred embodiments of the invention, it is to be understood that the invention is not limited thereof and that changes may be made therein without departing from the scope of the invention.

What is claimed is:

1. A process of preparing a fire resistant, cellulosic thermal insulation suitable for blowing into place consisting essentially of the steps of:

(a) feeding cellulosic material selected from the group consisting of hard wood chips, soft wood chips, straw, bagasse, and mixtures thereof, into a pressurized chamber, (b) pretreating said cellulosic material with steam under pressure and at an elevated temperature for a period of time sufficient to soften said cellulosic material and moisturize it by steam impregnation;

(c) passing the pretreated material to a fiberizing stage utilizing a refiner and injecting a fire retardant chemical selected from the group consisting of borax, boric acid, a borate, and mixtures thereof into said softened material at the eye of the refiner immediately before the grinding segments, (d) fiberizing under pressure for a sufficient period of time to produce an insulation grade cellulosic pulp, (e) discharging the fiberized material from the fiberizing stage and drying it.

2. The process of claim 1 in which the cellulosic material is pretreated with steam at about 60–150 psig and a temperature of about 270°–370° F. for 3–6 minutes.

3. The process of claim 1 in which said fire retardant chemical is borax.

4. The process of claim 3 in which the borax is injected into the cellulosic material in an amount of about 20–30 percent by weight based on bone dry material.

5. The process of claim 4 in which the borax is injected as a 20 percent concentrated aqueous solution.

6. The process of claim 4 in which the borax is injected as a dry powder.

7. The process of claim 1 in which the cellulosic material is fiberized in a single disc refiner.

8. A fire-resistant, cellulosic thermal insulation produced by the process of claim 1.

9. The insulation of claim 8 having a critical radiant flux value greater than 0.8 watts/cm$^2$.

* * * * *